US011112092B2

(12) United States Patent
Zhu et al.

(10) Patent No.: US 11,112,092 B2
(45) Date of Patent: Sep. 7, 2021

(54) STREET LAMP DEVICE

(71) Applicants: OPPLE LIGHTING CO., LTD., Shanghai (CN); SUZHOU OPPLE LIGHTING CO., LTD., Suzhou (CN)

(72) Inventors: Zenglong Zhu, Shanghai (CN); Hongbo Wang, Shanghai (CN); Qingjun Wei, Shanghai (CN); Guoping Wang, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 16/907,124

(22) Filed: Jun. 19, 2020

(65) Prior Publication Data

US 2020/0318813 A1 Oct. 8, 2020

Related U.S. Application Data

(63) Continuation of application No. PCT/CN2018/122175, filed on Dec. 19, 2018.

(51) Int. Cl.
*F21V 15/015* (2006.01)
*F21V 17/10* (2006.01)
(Continued)

(52) U.S. Cl.
CPC ..... *F21V 15/015* (2013.01); *F21V 17/107* (2013.01); *F21S 8/085* (2013.01);
(Continued)

(58) Field of Classification Search
CPC .. F21V 15/015; F21V 117/107; F21V 17/107; F21S 8/085; F21S 8/086; F21S 9/00; F21S 9/02; F21W 2131/103
See application file for complete search history.

(56) References Cited

U.S. PATENT DOCUMENTS 4,796,001 A * 1/1989 Gostyla ..... F21V 23/026 338/20
7,210,827 B1 * 5/2007 Haddad ..... F21V 19/04 362/375

(Continued)

FOREIGN PATENT DOCUMENTS

CN 201615444 U 10/2010
CN 202791460 U 3/2013

(Continued)

OTHER PUBLICATIONS

International Search Report of PCT Application No. PCT/CN2018/122175 dated Mar. 18, 2019, (5p).

*Primary Examiner* — Leah Simone Macchiarolo
(74) *Attorney, Agent, or Firm* — Arch & Lake LLP

(57) ABSTRACT

A streetlight device includes a power source portion and a lighting portion. The power source portion includes a driving power source, a power source base provided with a receiving space for receiving the driving power source, and a power source upper cover for closing the power source base. The lighting portion is connected at one end of the power source upper cover. The power source upper cover and the power source base are connected with each other through a hinge assembly. The power source upper cover is provided with a power source mounting assembly, and the driving power source is mounted onto the power source upper cover through the power source mounting assembly.

19 Claims, 6 Drawing Sheets

A — A

(51) Int. Cl.

| | |
|---|---|
| ***F21S 8/08*** | (2006.01) |
| ***F21V 17/12*** | (2006.01) |
| ***F21W 131/103*** | (2006.01) |
| *F21Y 115/10* | (2016.01) |
| *F21S 9/00* | (2006.01) |

(52) U.S. Cl.
CPC ..... *F21S 9/00* (2013.01); *F21V 17/12* (2013.01); *F21W 2131/103* (2013.01); *F21Y 2115/10* (2016.08)

(56) References Cited

U.S. PATENT DOCUMENTS

| | | | | |
|---|---|---|---|---|
| 7,430,120 | B2 * | 9/2008 | Lau | H01J 65/048 361/600 |
| 10,228,103 | B1 * | 3/2019 | Zhou | F21L 4/08 |
| 2006/0203500 | A1 * | 9/2006 | Lee | F21V 17/18 362/382 |
| 2007/0262719 | A1 * | 11/2007 | Lau | H01J 65/048 313/634 |
| 2009/0251898 | A1 * | 10/2009 | Kinnune | F21V 31/03 362/249.02 |
| 2011/0188256 | A1 * | 8/2011 | Tu | F21S 8/086 362/375 |
| 2014/0218941 | A1 * | 8/2014 | Wilcox | F21V 21/30 362/373 |
| 2014/0226339 | A1 | 8/2014 | Kinnune et al. | |
| 2017/0114986 | A1 | 4/2017 | Girouard et al. | |
| 2017/0307197 | A1 * | 10/2017 | Clark | H05B 45/54 |

FOREIGN PATENT DOCUMENTS

| | | | |
|---|---|---|---|
| CN | 203686911 | U | 7/2014 |
| CN | 206330100 | U | 7/2017 |
| CN | 107062000 | A | 8/2017 |
| CN | 207740939 | U | 8/2018 |

* cited by examiner

A — A

B—B

STREET LAMP DEVICE

CROSS-REFERENCE

The present application is based on and claims priority to PCT Patent Application No. PCT/CN2018/122175 filed on Dec. 19, 2018 which claims priority of the Chinese Patent Application No. 201711369440.4, filed on Dec. 19, 2017, titled "A STREET LAMP DEVICE" and Chinese Patent Application No. 201721771813.6, filed on Dec. 19, 2017, titled "A STREET LAMP DEVICE", the entire disclosure of which are incorporated herein by reference as part of the present application for all purposes.

TECHNICAL FIELD

The present application relates to the technical field of streetlight or street lamp, and particularly to a streetlight device.

BACKGROUND

In the lighting field, according to existing technology, a commonly used streetlight device mainly consists of a proof shell, a driving power source and a lamp panel provided with light-emitting diode (LED) particles, among which the driving power source is an easily damaged component. The proof shell includes an upper shell and a lower shell which are connected through a screw-bolt assembly and/or a locking assembly, so as to form a space for mounting the driving power source and the lamp panel. When the driving power source is damaged, it needs to dismount the upper shell or the lower shell to replace the driving power source. At the same time, the LED has a limited service life, and a process of replacing the lamp panel also needs to dismount the upper shell or the lower shell. When such kind of commonly used streetlight device is repaired, it needs to use a tool such as a screwdriver, aloft, to dismount the upper shell, so as to replace the driving power source and/or the lamp panel. Dismount of the upper shell involves considerably hard work, aloft storage of the dismounted upper shell is difficult, and dismount operation during an aloft work by using a tool has the risk that the tool may fall off.

Chinese invention application with publication No. CN104185760A and Chinese utility application with publication No. CN205155700U respectively disclose a streetlight device. These two types of streetlight devices each includes a power source base and a power source upper cover, a lighting module is connected at one end of the power source upper cover, the power source base is provided with a driving power source mounting base, the driving power source is mounted at the driving power source mounting base, and the power source upper cover is connected with the power source base through a hinge, among which one end of the hinge is fixed onto the power source base and the other end of the hinge is fixed onto the power source upper cover. When the driving power source is damaged, the power source portion is opened by rotating the power source upper cover around the hinge so as to repair the driving power source mounted at the power source base. These two types of streetlight devices do not have a complete structure consisted of an upper shell and a lower shell. Thus, it has not need of dismount the upper shell for repair, so as to solve the problem in the commonly used streetlight device that dismounting the upper shell involves considerably hard work; when the driving power source is repaired, the power source upper cover is still connected with the power source base through the hinge, so as to solve the problem in the existing technology that it's difficult to store the dismounted upper shell aloft. However, the foregoing streetlight devices still involve several problems. Firstly, because the lighting module is connected at one end of the power source upper cover and the lighting module is connected with a heat dissipating device, the end of the power source upper cover connected with the lighting module has a larger weight; while the power source upper cover is mounted at the power source base, the lighting module is protruded from one end of the power source upper cover and hung in the air, so that this end of the power source upper cover suffers more stress, and a locking device on the other end of the power source upper cover bears larger force, resulting in high security risk of the locking device and the streetlight. Secondly, the driving power source is easily damaged, and a dismount of the driving power source in the existing technology is inconvenient, which increases the repair difficulty. Thirdly, when the lighting module is damaged, it may be repaired by the following two methods: one method is to dismount and repair the lighting portion aloft, which requires an operator to stay aloft for long time, resulting in difficulty repairs because the aloft operation is inconvenient; the other method is to dismount the power source upper cover along with the lighting module connected at one end of the power source upper cover, in such case, a hinge is fixedly connected with the power source upper cover and the power source base, respectively, and a tool is required to dismount the power source upper cover, resulting in relatively complicated dismounting and mounting operation.

SUMMARY

The objective of the present application is to provide a streetlight device.

In order to achieve the objective above, the present application adopts the technical solutions as below.

In a first aspect of the application, a streetlight device is provided. The streetlight device includes a power source portion and a lighting portion. The power source portion includes a driving power source, a power source base provided with a receiving space for receiving the driving power source, and a power source upper cover for closing the power source base. The lighting portion is connected at one end of the power source upper cover. At least one side between the power source upper cover and the power source base is connected through a hinge assembly. The power source upper cover is provided with a power source mounting assembly, and the driving power source is mounted at the power source upper cover through the power source mounting assembly.

Figure 1:
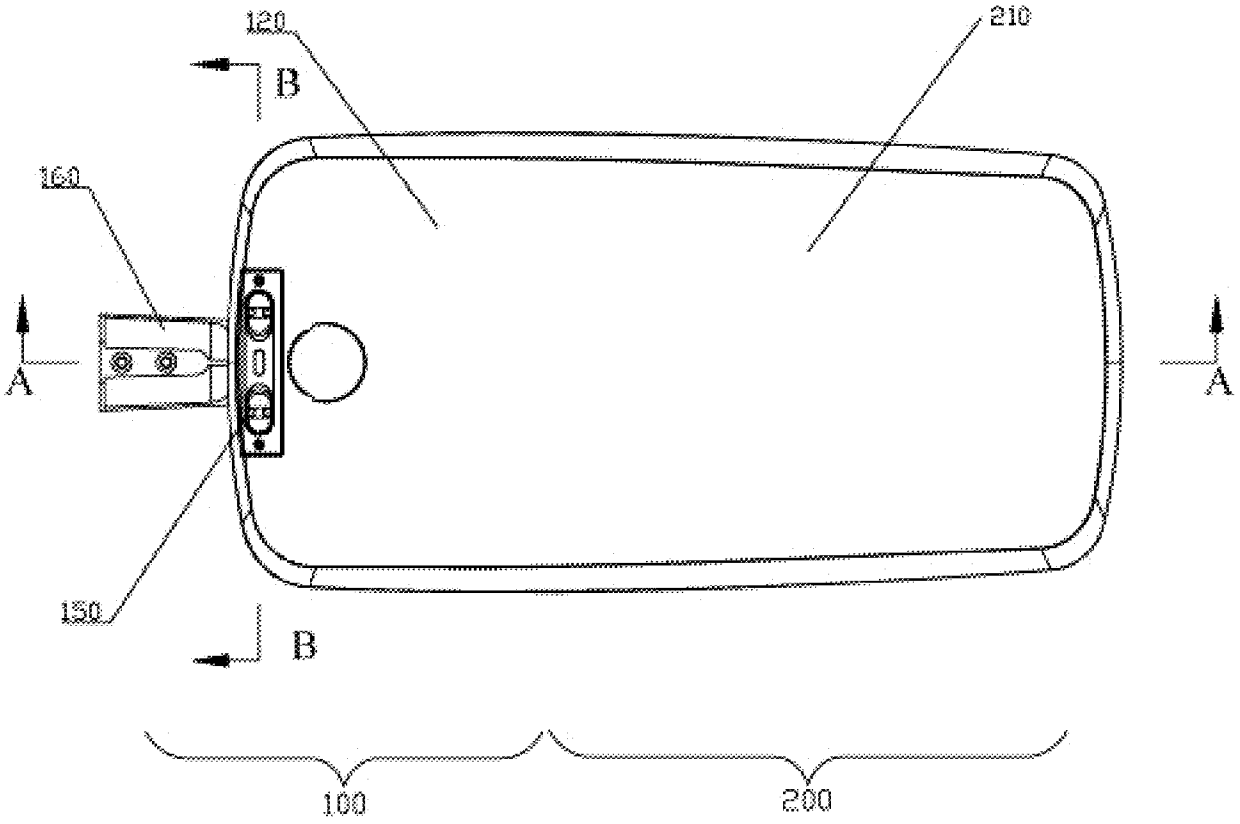
FIG. 1 is a top view of a streetlight device in accordance with an example of the present application.

100—power source portion; 110—power source base; 120—power source upper cover; 130—driving power source; 140—hinge assembly; 141—hinge mount; 142—hinge plate; 1421—pivot hole; 143—hinge pivot; 144—hinge lever; 145—locating insert plate; 146—pivot limiting part; 150—locking assembly; 151—clamping mount; 152—clamping plate; 1521—clamping hole; 1522—clamping guide part; 153—clamping pin; 154—clamping pin lever; 155—clamping pin resetting spring; 156—clamping pin limiting protrusion; 157—clamping pin resetting barrier; 160—lamp post cooperating part; 170—power source mounting assembly; 171—supporting plate slot; 172—power source supporting plate; 1721—supporting plate locking hole; 1722—handled screw avoidance hole; 173—threaded hole; 174—handled screw; 181—first electrical connector; 182—second electrical connector; 200—lighting portion; 210—upper lighting shell; 220—lower lighting shell; 230—dustproof transparent mask; 240—lighting module.

DETAILED DESCRIPTION

Hereinafter, particular implementations of the present application will be further described in details in connection with drawings and embodiments. The embodiments below are merely for the purpose of explaining the present application without limiting the scope thereof.

First Embodiment

Referring to FIGS. 1-8, in one of preferred embodiments of the streetlight device of the present application, the streetlight device includes a power source portion 100 and a lighting portion 200; the power source portion 100 includes a driving power source 130, a power source base 110 provided with a receiving space for receiving the driving power source 130, and a power source upper cover 120 for closing the power source base 110. The lighting portion 200 is connected at one end of the power source upper cover 120; the lighting portion 200 and the power source upper cover 120 may be formed into an integral part or may be separate parts. Here, a streetlight device may also be referred as a street lamp device.

At least one side between the power source upper cover 120 and the power source base 110 is connected through a hinge assembly 140. The power source upper cover 120 is provided with a power source mounting assembly 170, and the driving power source 130 is mounted onto the power source upper cover 120 through the power source mounting assembly 170. The power source mounting assembly 170 is disposed at an internal side of the power source upper cover 120, the internal side of the power source upper cover 120 refers to a side of the power source upper cover 120 facing towards the power source base 110 when the power source upper cover 120 closes the power source base 110. By mounting the power source on the power source upper cover 120 through the power source mounting assembly 170, the weight of the driving power source 130 is used for balancing the gravitational force of the lighting portion 200 which is protruded from one end of the power source upper cover 120 and hung in the air, so that the mounting operation of the power source upper cover 120 is relatively stable and the security of the streetlight device is increased.

The power source mounting assembly is implemented in various ways. In one or more implementations, referring to FIG. 2, FIG. 3 and FIG. 8, the power source mounting assembly 170 in the present embodiment includes a power source supporting plate 172 and a supporting plate fixing mechanism (not labeled), the driving power source 130 is mounted onto the power source supporting plate 172, and the power source supporting plate 172 is mounted onto the power source upper cover 120 through the supporting plate fixing mechanism. By fixing the driving power source 130 on the power source supporting plate 172 and then by mounting the supporting plate fixing mechanism on the power source upper cover, which achieves the modularization of the power source mounting assembly, and facilitates the mounting and dismounting operation of the driving power source 130. When the driving power source 130 is damaged, it can be replaced together with the power source supporting plate 172. Before the repairs, the power source supporting plate 172 is provided, the driving power source 130 is fixedly mounted onto the power source supporting plate 172, and the power source supporting plate 172 is connected with the driving power source 130 through gluing, welding, or screws for use.

In the present embodiment, the supporting plate fixing mechanism includes a supporting plate slot 171 disposed at the power source upper cover 120, and a supporting plate locking structure (not labeled); one end of the power source supporting plate 172 is inserted into the supporting plate slot 171, and at least one of the other end(s) of the power source supporting plate 172 except the end inserted into the supporting plate slot 171 is fixed on the power source upper cover 120 through the supporting plate locking structure. As illustrated in the figure(s), in the present embodiment, the supporting plate locking structure is disposed at an end opposite to the end inserted into the supporting plate slot 171; the supporting plate locking structure includes a threaded hole 173 disposed at the power source upper cover 120 and a handled screw 174 for threaded connection with the threaded hole 173; at least one end of the other end(s) of the power source supporting plate 172 except the end inserted into the supporting plate slot 171 is provided with a locking hole 1721, as illustrated in the figure(s), the locking hole 1721 is disposed at an end opposite to the end inserted into the supporting plate slot 171, and the handled screw 174 partly passes through the locking hole 1721 and is connected with the threaded hole 173 so as to tightly lock the power source supporting plate 172. For replacing, the handled screw 174 is unscrewed manually, the power source supporting plate 172 along with the driving power source 130 is pulled out of the supporting plate slot 171, at the same time, a new power source supporting plate 172 with a driving power source 130 is inserted into the supporting plate slot 171, and then the handled screw 174 is tightened so as to finish replacing the driving power source 130. The entire repair process does not need to use any repair tool, which reduces the difficulty of repair operation as compared with the existing technology.

Figure 8:
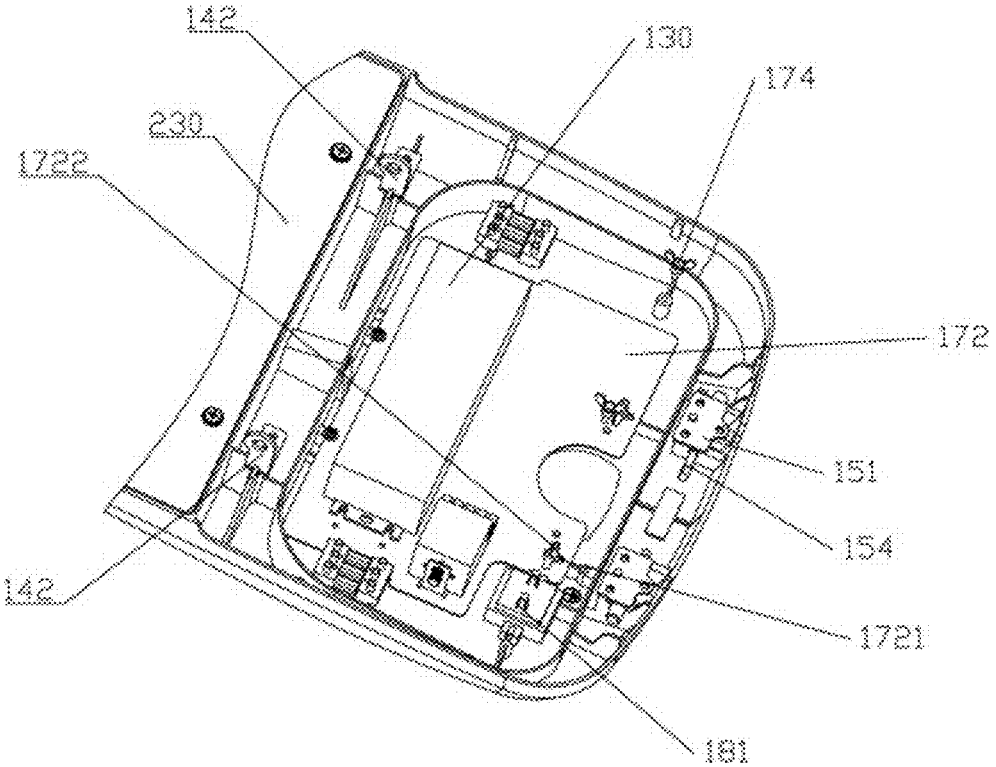
FIG. 8 is a perspective view of a power source upper cover of a streetlight device in accordance with an example of the present application.

As illustrated in FIG. 8, the power source supporting plate 172 may be further provided with a handled screw avoidance hole 1722 for allowing the entire handled screw to pass therethrough, and the handled screw avoidance hole 1722 is connected with the locking hole through an elongated hole; when dismounting the power source supporting plate, the handled screw is unscrewed, the power source supporting plate 172 is moved along the elongated hole between the handled screw avoidance hole 1722 and the locking hole so that the handled screw 174 passes through the handled screw avoidance hole 1722, and then the power source supporting plate 172 is removed from the supporting plate slot 171; during the repair process, the handled screw 174 is connected in the screw hole, which prevents from losing the dismounted handled screw.

Further, the supporting plate slot 171 is mounted onto the power source upper cover 120 through a slot hinge (not shown in the figures), and the supporting plate slot 171 is rotatable around the slot hinge. When mounting or dismounting the power source supporting plate, the supporting plate slot 171 may be rotated around the slot hinge so as to facilitate mounting the power source supporting plate 172.

In another embodiment, the supporting plate slot 171 is mounted onto the power source upper cover 120 through a slot hinge (not shown in the figures), and the supporting plate slot 171 is rotatable around the slot hinge; the supporting plate locking structure is a spring lock structure, the spring lock structure may be a spring lock in the existing technology and is applied to the power source supporting plate of the present application for locking. The supporting plate locking structure is preferably disposed at an end opposite to the end of the power source supporting plate inserted into the supporting plate slot; the supporting plate locking structure includes a supporting plate locking bracket, a supporting plate locking spring, a supporting plate locking tongue, and a locking tongue lever; the supporting plate locking bracket is fixed onto the power source upper cover, and the supporting plate locking bracket is close to a position where the power source supporting plate is rotated to approach the power source upper cover after the power source supporting plate is inserted into the supporting plate slot; the supporting plate locking bracket is provided with a locking tongue hole and the locking tongue hole is open towards the power source supporting plate; the supporting plate locking tongue is disposed in the locking tongue hole through an extension-compression of the supporting plate locking spring. In this case, part of the supporting plate locking tongue may be stretched out to the position of the power source supporting plate and may also be withdrawn back to the supporting plate locking bracket; the locking tongue lever is connected with the supporting plate locking tongue; when the supporting plate locking tongue is stretched out, a clamping space is formed between the supporting plate locking tongue and the power source upper cover. In the mounting operation, the power source supporting plate is inserted into the supporting plate slot, and the supporting plate slot is rotated to cause the part of the supporting plate locking tongue that is stretched out to be withdrawn back to the supporting plate locking bracket; after the supporting plate is rotated to a certain position, the supporting plate locking tongue is stretched out to cause the power source supporting plate to be clamped into the clamping space formed by the supporting plate locking tongue and the power source upper cover so as to lock up the power source supporting plate; then the mounting operation is finished. In the dismounting operation, the locking tongue lever is triggered to cause the supporting plate locking tongue to be withdrawn back, and the power source supporting plate is rotated so as to be escaped from the supporting plate slot, then the dismounting operation of the power source supporting plate is finished.

Further, as illustrated in FIG. 2, FIG. 4, FIG. 6 and FIG. 8, the hinge assembly 140 includes a hinge mount 141, a hinge pivot 143 and a hinge plate 142; the hinge pivot 143 is telescopically disposed at the clamping mount 141 and is connected with a pivot handle 144. The hinge plate 142 is provided with a pivot hole 1421. The hinge mount 141 is disposed at the power source base 110, the hinge mount 141 and the power source base 110 are fixedly connected with each other through a screw or integrally formed. The hinge plate 142 is disposed at the power source upper cover 120, the hinge plate 142 and the power source upper cover 120 are fixedly connected with each other through a screw or integrally formed. In this case, the hinge pivot 143 may insert into the pivot hole 1421 to be connected to the hinge plate 142, so as to realize rotating the power source upper cover 120 to close or open the power source base 110. The number of the hinge assembly 140 is chosen according to demands. For example, the hinge assemblies 140 may be arranged at all sides between the power source base 110 and the power source upper cover 120; or, the hinge assemblies 140 may be arranged at two opposite sides between the power source base 110 and the power source upper cover 120, each of the two sides may be provided with a plurality of hinge assemblies 140, and the plurality of hinge assemblies 140 disposed at a same side are arranged coaxially. As illustrated in the figures, in the present embodiment, one side of the power source base 110 and the power source upper cover 120 is provided with two hinge assemblies 140, and hinge pivots 143 of the two hinge assemblies 140 are arranged coaxially. The hinge plate 142 and the hinge mount 141 are connected with each other through the hinge pivot 143, and the power source upper cover 120 is rotated around the hinge pivot 143. The power source base 110 is provided with an electrically connecting wire, one end of the electrically connecting wire is used for connection with the driving power source and the other end of the electrically connecting wire is used for electrical connection to external city power so as to power the driving power source; the power source base provided with the electrically connecting wire is easily understood for those skilled in the art. The driving power source 130 drives the lighting portion 200 to emit light.

When mounting the power source upper cover, the power source upper cover 120 and the lighting portion 200 are held by hands, the hinge plate 142 is moved to approach to the hinge mount 141 and is placed in front of a front end of the hinge pivot 143, the pivot handle 144 is held by hands and is pushed to drive the hinge pivot 143 to be inserted into the pivot hole 1421, so as to finish the connection between the power source upper cover 120 and the power source base 110; the power source base 110 can be closed by rotating the power source upper cover 120 around an axial center of the hinge pivot 143. In a dismounting operation for repair, the power source upper cover 120 is rotated, the power source base 110 is opened, the pivot handle 144 is grabbed by hands to pull the hinge pivot 143 out of the pivot hole 1421, then the power source upper cover 120 is separated from the power source base 110, and the power source upper cover 120 is taken off for repair. When the lighting portion is damaged, the power source upper cover along with the lighting portion connected at one end of the power source upper cover may be quickly dismounted for repair without the need of using a tool to dismount the power source upper cover, which leads to relatively simpler mounting and dismounting operation. Furthermore, the driving power source and the lighting module that are most likely to be repaired and replaced are integrated, which effectively increases the efficiency and convenience of repair and replacement, and prevents from dismounting and repairing/replacing the driving power source and the lighting module separately. Moreover, it further facilitates the update of products; when more functions are developed, for example, when a combination of control module and communication module is added, it may be directly mounted onto the power source lower cover to finish updating. The power source upper cover of the streetlight device in the present application is simple for mounting and dismounting, which realizes quick mounting and dismounting without using a tool, facilitates the repair, and increases the security of repair operation.

Figure 5:
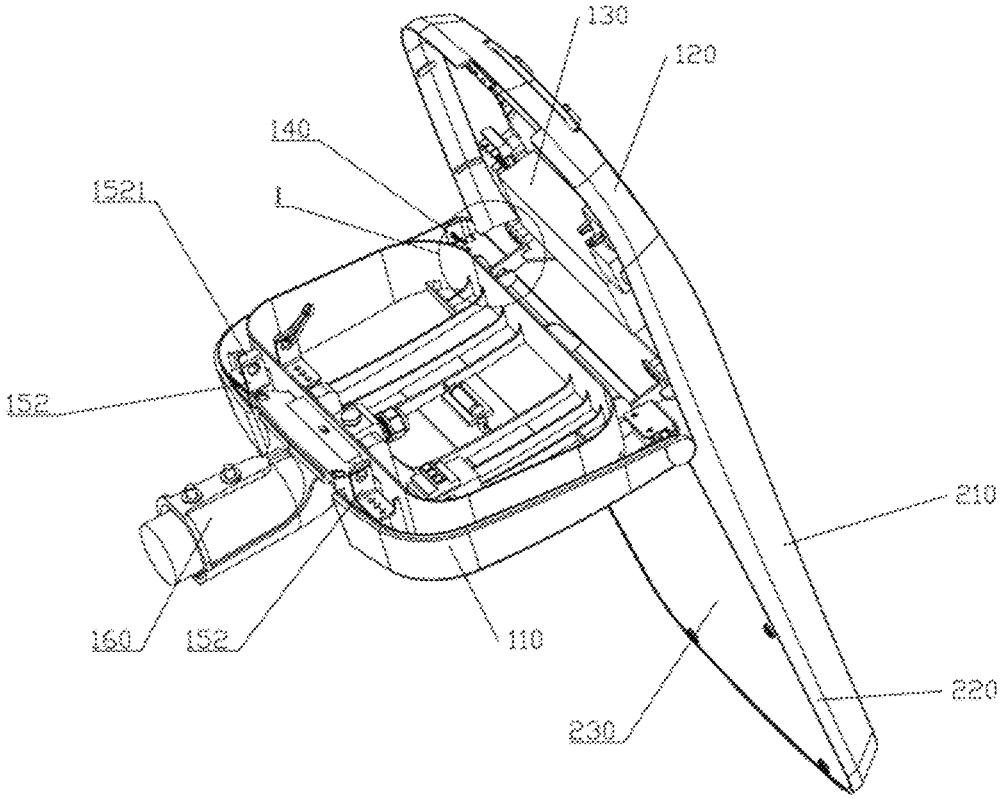
FIG. 5 is a perspective view of a streetlight device (in an open state) in accordance with an example of the present application.
Figure 6:
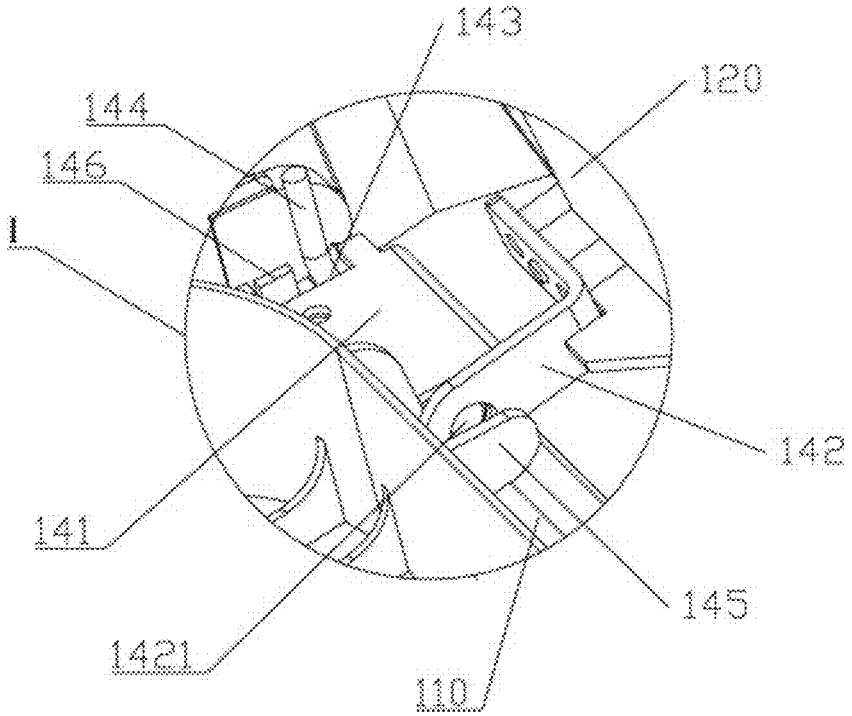
FIG. 6 is an enlarged view of part I of a streetlight device in accordance with an example of the present application as illustrated in FIG. 5.
Figure 7:
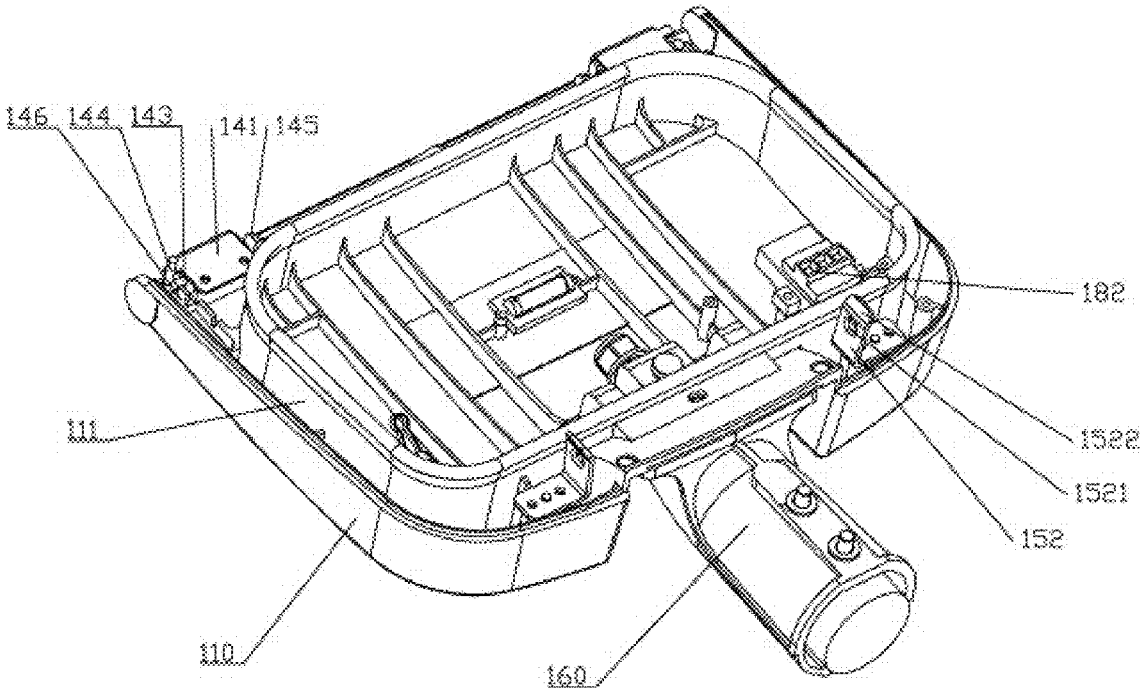
FIG. 7 is a perspective view of a power source base of a streetlight device in accordance with an example of the present application.

In some implementations, referring to FIG. 5, FIG. 6 and FIG. 7, a position closing to the hinge mount 141 and being protruded from the front end of the hinge pivot 143 is provided with a locating slot (not labeled), the hinge plate 142 is inserted into the locating slot, and the hinge pivot 143 is protruded into the locating slot and inserted into the pivot hole 1421. The locating slot may be directly disposed on the hinge mount 141, and may also be the case that a locating insert plate 145 is disposed on the power source upper cover 120, and the locating insert plate 145 and the hinge mount 141, together, form a locating slot, as illustrated in the figures. The locating slot is used for receiving the hinge plate 152 and locating the hinge plate 142 in position, the hinge plate 142 is capable of rotating in the locating slot, and an angle of an opening of the locating slot is preferably from 90° to 150°. In the mounting operation, the hinge plate 142 is inserted into the locating slot, and the pivot handle 144 is moved to drive the hinge pivot 143 to be protruded into the pivot hole 1421 of the hinge plate 142 located in the locating slot. By using the locating slot for locating, when an operating personnel mounts the power source upper cover 120, he/she only needs to insert the hinge plate 142 into the locating slot to realize the alignment between the hinge pivot 142 and the pivot hole 1421, thus the hinge pivot 143 can be inserted into the pivot hole 1421 quickly and correctly, which achieves a simpler and safer mounting operation of the power source upper cover 120.

In some implementations, referring to FIGS. 5-7, the hinge mount 141 is provided with a pivot limiting part 146 for jointing with the pivot handle 144 so as to limit the displacement of the hinge pivot 143. After the hinge pivot 143 is inserted into the pivot hole 1421, the pivot handle 144 is rotated to be clamped into the pivot limiting part 146, which restraints the hinge pivot 143 from escaping out of the pivot hole 1421, ensures appropriate mounting of the power source upper cover 120, and prevents the power source upper cover 120 from falling off.

Figure 2:
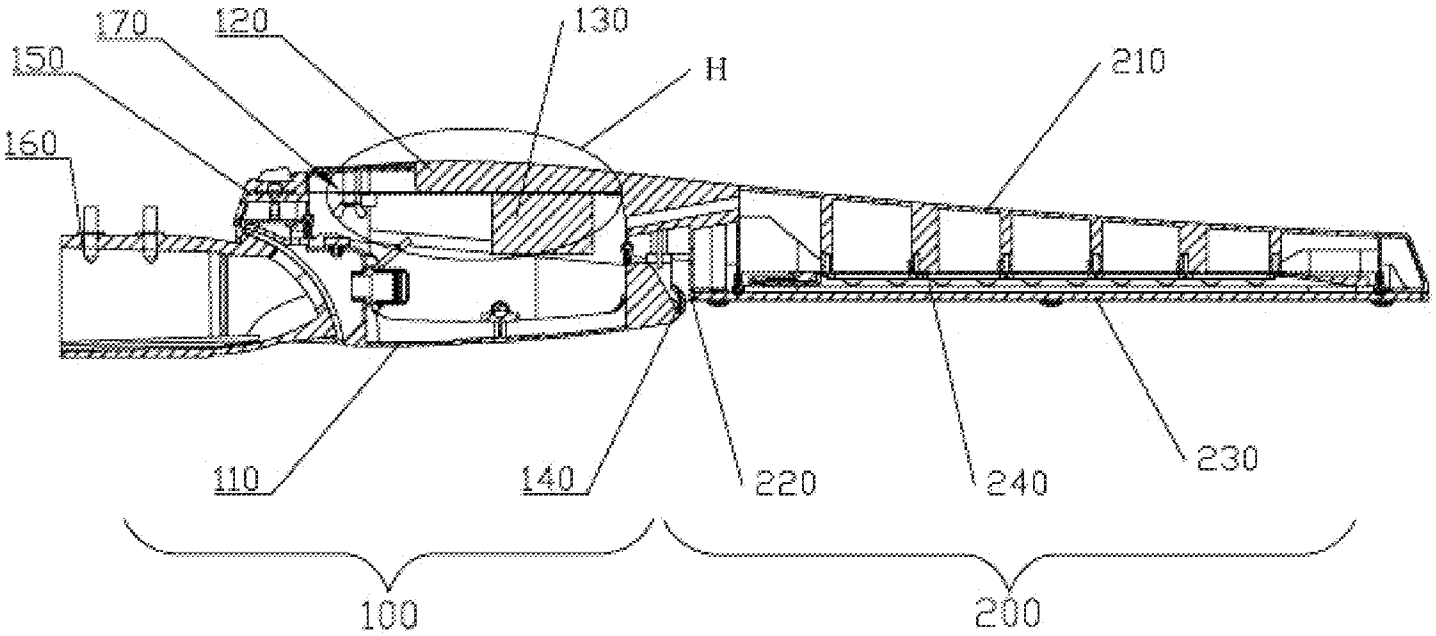
FIG. 2 is a sectional view of a streetlight device in accordance with an example of the present application along A-A direction in FIG. 1.
Figure 3:
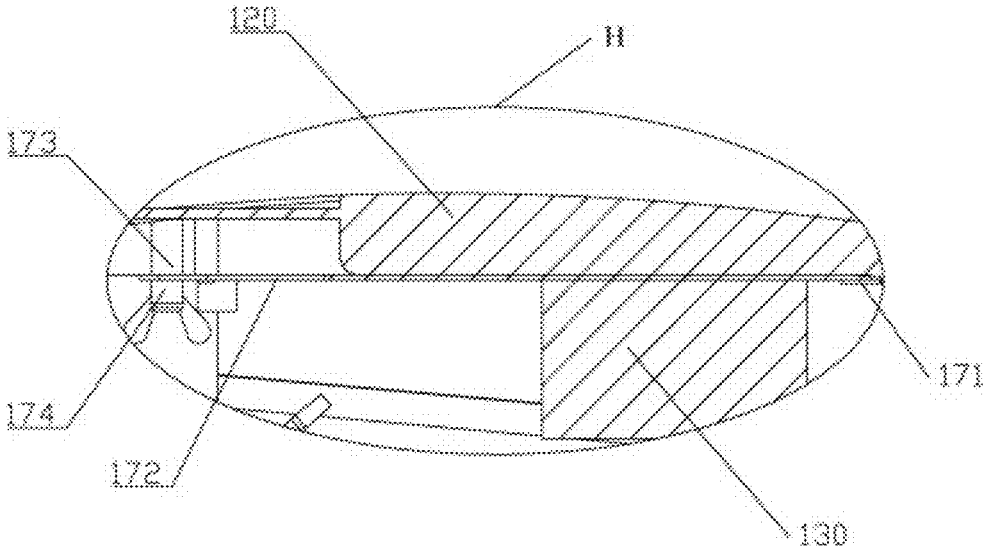
FIG. 3 is an enlarged view of part H of a streetlight device in accordance with an example of the present application as illustrated in FIG. 2.

In some implementations, referring to FIG. 2, FIG. 3 and FIG. 8, the hinge assembly 140 of the present application is disposed at one side of the power source upper cover 120 and the lighting portion 200. The driving power source 130 having a relatively larger weight is mounted at the power source upper cover 120 for balancing the weight of the lighting portion 200 at an end of the power source upper cover 120, which reduces a leverage force subjected by the hinge assembly 140 and increases the security of the streetlight device. In the repair operation, when the power source upper cover 120 is dismounted, the driving power source 130 and the lighting portion 200 that are most likely damaged may be dismounted along with the power source upper cover 120, without the need of hanging the power source upper cover 120 at the lamp post of the streetlight for repairing, which reduces the repair difficulty.

In some implementations, referring to FIG. 5 and FIG. 7, a receiving space of the power source base 110 is provided with an internal compartment 111, the internal compartment 111 and the power source upper cover 120, together, form a compartment space for receiving the driving power source 130. When the power source base 110 is assembled with the power source upper cover 120, the internal compartment 111 and the power source upper cover 120, together, form the compartment space for receiving the driving power source 130. The driving power source 130 is sealed and isolated from the outside of the power source chamber, which ensures power supply security and prevents the driving power source 130 from being damaged due to moisture. Further, in order to ensure good sealing performance of the power source chamber, a sealing ring is disposed at an upper edge of the internal compartment 111, and the sealing ring is jointed with the power source upper cover to form a sealing.

In some implementations, referring to FIG. 5, FIG. 7 and FIG. 8, the streetlight device is further provided with a driving adapter assembly, the driving adapter assembly includes a first electrical connector 181 disposed at the power source upper cover 120 and a second electrical connector 182 disposed at the power source base 119, and the driving power source 130 is connected with the first electrical connector 181; in this case, the first electrical connector 181 and the second electrical connector 182 constitute a plug-in connection while the power source upper cover 120 is rotated to close the power source base 110; the first electrical connector 181 is separated from the second electrical connector 182 while the power source upper cover 120 is rotated to open the power source base 110. In the mounting process, rotating the power source upper cover 120 to close the power source base 110 allows the first electrical connector 181 to be jointed with the second electrical connector 182, so that the electrically connecting wire is electrically connected to the driving power source 130 through the driving adapter assembly; in the dismounting process for repair, rotating the power source upper cover 120 to open the power source base 110 allows the first electrical connector 181 to be separated from the second electrical connector 182, so as to further simplify the dismounting process. The driving power source 130 is disposed at the power source upper cover 120. When the streetlight device is found damaged, the field repair can be finished in most cases upon merely dismounting the power source upper cover and the lighting portion and then replacing with undamaged power source upper cover 120 and lighting portion 200. This is because the power source base 110 is only provided with the electrically connecting wire and is not easily damaged. As for the specific damaged part of the streetlight device, it can be tested and repaired after being taken back indoor or taken back to the ground, in this way, the repair operator has no need of outdoor working for long time, which reduces the working intensity of the repair operator. During the field repair, the repair operator doesn't need to use a repair tool at all, which mitigates the trouble caused by bringing the repair tool to the repair site.

In some implementations, in the present embodiment, the driving power source 130 and the first electrical connector 181 are connected with each other through a quick coupling. Male and female power connections are chosen to be used as the quick coupling. When the driving power source is damaged, disconnecting the quick coupling allows for replacing the driving power source; both the mounting and dismounting process do not need to use a tool, which facilitates dismounting the driving power source.

Figure 4:
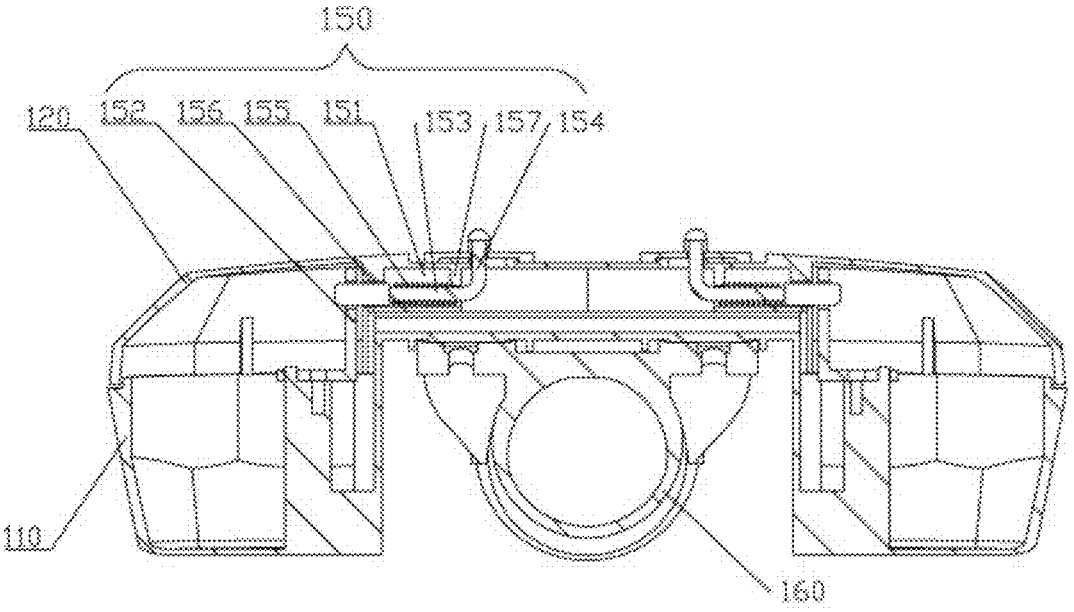
FIG. 4 is a sectional view of a streetlight device in accordance with an example of the present application along B-B direction in FIG. 1.

Further, a locking assembly 150 is further disposed between the power source base 110 and the power source upper cover 120 for realizing locking when the power source upper cover 120 closes the power source base 110; the locking assembly and the hinge assembly are disposed at different sides, respectively. As illustrated in FIG. 4, the locking assembly 150 is disposed at a side opposite to the side where the hinge assembly 140 is disposed. The locking assembly 150 may be implemented in various ways, for example, bolt-nut locking assembly and snap-fit locking assembly, which are easily understood by those skilled in the art.

In some implementations, referring to FIG. 4, the locking assembly 150 includes a clamping mount 151 disposed on the power source upper cover 120, a clamping pin 153 telescopically disposed at the clamping mount 151, and a clamping plate 152 disposed at the power source base 110; the clamping mount 151 is provided with a clamping pin resetting barrier 157, a rear end of the clamping pin 153 passes through the clamping pin resetting barrier 157, the rear end of the clamping pin 153 is connected with a clamping pin lever 154, and a front end of the clamping pin 153 is provided with a clamping pin limiting protrusion 156; the clamping pin 153 is sleeved with a clamping pin resetting spring 155, the clamping pin resetting spring 155 is abutted between the clamping pin limiting protrusion 156 and the clamping pin resetting barrier 157. The clamping plate 152 is provided with a clamping hole 1521, when the power source upper cover 120 closes the power source base 110, the front end of the clamping pin 153 is inserted into the clamping hole 1521 to be connected to the clamping plate 152. When the power source upper cover 120 closes the power source base 110, the clamping pin lever 154 is pushed strenuously such that the front end of the clamping pin 153 is withdrawn back; after the power source upper cover 120 is assembled with the power source base 110, the clamping pin lever 154 is released, and the front end of the clamping pin 153 is inserted into the clamping hole 1521 under the elastic effect of the clamping pin resetting spring 155, so as to realize locking the power source upper cover with the power source base. In the dismounting operation, the clamping pin lever 154 is held by hands and is pushed strenuously to overcome the elastic force of the clamping pin resetting spring 155, so as to cause the clamping pin 153 to be escaped out of the clamping hole 1521; and the power source upper cover 120 is rotated around the hinge pivot 143 to open the power source base 110. The locking assembly in the present embodiment has simple structure, allows for convenient mounting and dismounting operation of the power source upper cover, and possesses high security coefficient.

Further, an end of the clamping plate 152 away from the power source base is provided with a clamping guide part 1522 for jointing with the clamping pin 153, so as to guide the clamping pin 153 into the clamping hole 1521. In the mounting operation of assembling the power source base 110 with the power source upper cover 120, the end of the clamping pin 153 is jointed with the clamping guide part 1522; when the power source upper cover 120 is strenuously pressed, the clamping guide part 1522 overcomes the elastic force of the clamping pin resetting spring 155, and the clamping pin 153 continues to move downwards until the end of the clamping pin 153 is aligned with the clamping hole 1521; at this moment, the clamping pin is protruded into the clamping hole 1521 under the effect of the clamping pin resetting spring 155, so as to finish the clamping action; the mounting operation is simpler.

The present application realizes dismounting the power source upper cover and the lighting portion without using a tool, by the arrangement of the hinge assembly and locking assembly; the driving power source is mounted onto the power source upper cover so as to balance the gravitational force of the lighting portion, thereby increasing the security of the streetlight device; the power source mounting assembly allows for mounting and dismounting the driving power source without using a tool.

Further, as illustrated in FIG. 2, the lighting portion 200 includes an upper lighting shell 210, a lower lighting shell 220 and a lighting module 240; the upper lighting shell 210 is integrally connected with the power source upper cover 120; the lower lighting shell 220 is provided with a dustproof transparent mask 230; the upper lighting shell 210 and the lower lighting shell 220 are connected with each other to form a lamp panel space in which the lighting module 240 is disposed; the lighting module 240 and the driving power source 130 are connected with each other through quick coupling, and the quick coupling preferably adopts male and female quick coupling. The lighting module includes a substrate and a light source disposed on the substrate, the light source is a LED light source, the substrate is mounted at the upper lighting shell, the upper lighting shell is provided with several heat dissipation ribs, and the substrate contacts the heat dissipation ribs for heat dissipation. The LED light source is covered by an optical module so as to scatter light beams emitted from the LED light source, which allows for more uniform light. The light emitted by the LED light source exits from the dustproof transparent mask 230.

Here, the hinge assembly 140 further includes a pivot resetting mechanism (not shown in the figures), the pivot resetting mechanism is used for resetting the hinge pivot 143 to a stretched-out state. It is conceived by those skilled in the art that the pivot resetting mechanism may be implemented in multiple ways, which will not be illustrated herein one by one. For example, the arrangement of the pivot resetting mechanism in the present embodiment is substantially the same as that of the resetting mechanism of the above-described locking assembly. The structure of the pivot resetting mechanism is as follows: the hinge mount is provided with a pivot chute, the pivot chute is provided with a pivot resetting barrier, the hinge pivot passes through the pivot resetting barrier, the hinge pivot is provided with a pivot limiting protrusion, and a pivot resetting spring is disposed between the pivot limiting protrusion and the pivot resetting barrier so as to cause the pivot to be reset to the stretched-out state without an effect of external force. The hinge mount is provided with a pivot resetting switch; when the hinge pivot is withdrawn back, the hinge pivot is locked up by the pivot resetting switch and is unable to restore; and when the hinge pivot needs to be reset and stretched out, the pivot resetting switch is operated to unlock the hinge pivot so that the hinge pivot is stretched out under the effect of the pivot resetting spring. The pivot resetting switch is a triggered-type pivot resetting switch associated with the hinge plate, and the pivot resetting switch may adopt a lever-type resetting switch structure.

The streetlight device further includes a lamp post (not shown in the figures), and the power source base 110 is provided with a lamp post cooperating part 160 connected with the lamp post. The interior of the lamp post is hollow, and the electrically connecting wire of the power source base passes through the hollowed interior of the lamp post to be connected to the city power.

Second Embodiment

The present embodiment is substantially same as the first embodiment. For convenience of description, the portion(s) of the present embodiment identical with that of the first embodiment will not be repeatedly described herein. The difference lies in that, in the present embodiment, the hinge mount is disposed at the power source upper cover, and the hinge plate is disposed at the power source base.

As an example, the power source mounting assembly includes a power source supporting plate and a supporting plate fixing mechanism, the driving power source is mounted onto the power source supporting plate, and the power source supporting plate is mounted onto the power source upper cover through the supporting plate fixing mechanism.

As an example, the supporting plate fixing mechanism includes a supporting plate slot disposed at the power source upper cover and a supporting plate locking structure, one end of the power source supporting plate is inserted into the supporting plate slot, and at least one of other ends of the power source supporting plate except the end inserted into the supporting plate slot is fixed onto the power source upper cover through the supporting plate locking structure.

As an example, the supporting plate locking structure includes a threaded hole disposed at the power source upper cover and a handled screw for threaded connection with the threaded hole, at least one of the other ends of the power source supporting plate except the end inserted into the supporting plate slot is provided with a locking hole, and the handled screw partly passes through the locking hole to be connected to the threaded hole so as to lock the power source supporting plate.

As an example, the supporting plate slot is mounted onto the power source upper cover through a slot hinge.

As an example, the supporting plate locking structure includes a supporting plate locking bracket, a supporting plate locking spring, a supporting plate locking tongue, and a locking tongue lever; the supporting plate locking bracket is fixed onto the power source upper cover, the supporting plate locking bracket is provided with a locking tongue hole and the locking tongue hole is open towards the power source supporting plate; the supporting plate locking tongue is disposed at the locking tongue hole through an extension-compression of the supporting plate locking spring, and the locking tongue lever is connected with the supporting plate locking tongue.

As an example, the power source base is provided with an internal compartment, and the internal compartment and the power source upper cover together form a compartment space for receiving the driving power source.

As an example, an upper edge of the internal compartment is provided with a sealing ring, and the sealing ring and the power source upper cover form a joint sealing.

As an example, the streetlight device is further provided with a driving adapter assembly, the driving adapter assembly includes a first electrical connector disposed at the power source upper cover and a second electrical connector disposed at the power source base; the driving power source is connected to the first electrical connector, wherein the first electrical connector and the second electrical connector form a plug-in connection while the power source upper cover is rotated to close the power source base.

As an example, the driving power source and the first electrical connector are connected with each other through a quick coupling.

As an example, a locking assembly is further disposed between the power source upper cover and the power source base, the locking assembly is used for realizing locking while the power source upper cover closes the power source base; the locking assembly and the hinge assembly are disposed at different sides of the power source upper cover and the power source base, respectively.

As an example, the locking assembly includes a clamping mount disposed at the power source upper cover, a clamping pin telescopically disposed at the clamping mount, and a clamping plate disposed at the power source base; a rear end of the clamping pin is connected with a clamping pin lever, a front end of the clamping pin is provided with a clamping pin limiting protrusion; the clamping mount is provided with a clamping pin resetting barrier, the rear end of the clamping pin passes through the clamping pin resetting barrier; the clamping pin is sleeved with a clamping pin resetting spring, the clamping pin resetting spring is elastically abutted between the clamping pin limiting protrusion and the clamping pin resetting barrier; the clamping plate is provided with a clamping hole; and the front end of the clamping pin is inserted into the clamping hole under an effect of the clamping pin resetting spring when the power source upper cover closes the power source base.

As an example, an end of the clamping plate away from the power source base is provided with a clamping guide part for jointing with the clamping pin so as to guide the clamping pin into the clamping hole.

As an example, the hinge assembly includes a hinge mount, a hinge pivot and a hinge plate; the hinge pivot is telescopically disposed at the hinge mount and is connected with a pivot handle; the hinge plate is provided with a pivot hole, the hinge mount is disposed at the power source base, and the hinge plate is disposed at the power source upper cover; or, the hinge mount is disposed at the power source upper cover, and the hinge plate is disposed at the power source base; wherein the hinge pivot is inserted into the pivot hole to realize rotating the power source upper cover so as to close or open the power source base.

As an example, the hinge mount is provided with a pivot limiting part for jointing with the pivot handle so as to limit a displacement of the hinge pivot.

As an example, the hinge assembly further includes a pivot resetting mechanism for resetting the hinge pivot to a stretched-out state.

As an example, a position that is close to the hinge mount and is protruded from a front end of the hinge pivot is provided with a locating slot, the hinge plate is inserted into the locating slot, and the hinge pivot is protruded into the locating slot and is inserted into the pivot hole.

As an example, the lighting portion includes an upper lighting shell, a lower lighting shell, and a lighting module; the upper lighting shell is integrally connected with the power source upper cover, the lower lighting shell is provided with a dustproof transparent mask, the upper lighting shell is connected with the lower lighting shell to form a lamp panel space, the lighting module is disposed within the lamp panel space, and the lighting module and the driving power source are connected with each other through a quick coupling.

As compared with the existing technology, the streetlight device of the present application possesses the following advantages:

Firstly, the driving power source is mounted onto the power source upper cover, and the gravitational force of the driving power source is used for balancing the gravitational force of the lighting portion which is protruded from one end of the power source upper cover and hung in the air, so that the mounting operation of the power source upper cover is relatively stable and the security of the streetlight device is increased;

Secondly, the driving power source is easily damaged; by realizing manually mounting and dismounting the driving power source through the power source mounting assembly, the effect of simple and quick repair is achieved;

Thirdly, when the lighting portion is damaged, the power source upper cover along with the lighting portion connected at one end of the power source upper cover may be quickly dismounted for repair without the need of using a tool to dismount the power source upper cover, resulting in simple mounting and dismounting operation. The power source upper cover of the streetlight device in the present application is easy for mounting and dismounting, so as to realize quick mounting and dismounting without using a tool and increase the security of the repair operation.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the apparatus or system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

It should be noted that, the embodiments of the present application contain preferred ones which are not limitative of the present application in any form; any of those skilled familiar with the related arts can make variations and modifications by using the above disclosure to obtain equivalent effective embodiments; any contents that are not departing from the technical solutions of the present application, and any changes or equivalent variations and modifications to the above embodiments in accordance with the technical essences of the present application, are all still fallen within the scopes of technical solutions of the present application.

We claim:

1. A streetlight device, comprising:

a power source portion comprising a driving power source, a power source base provided with a receiving space for receiving the driving power source, and a power source upper cover for closing the power source base;

a lighting portion connected at one end of the power source upper cover, and a locking assembly is further disposed between the power source upper cover and the power source base, wherein at least one side between the power source upper cover and the power source base is connected through a hinge assembly, wherein the power source upper cover is provided with a power source mounting assembly, wherein the power source mounting assembly comprises a power source supporting plate and a supporting plate fixing mechanism, the driving power source is mounted onto the power source supporting plate, and the power source supporting plate is mounted onto the power source upper cover through the supporting plate fixing mechanism, wherein the driving power source is mounted onto the power source upper cover through the power source mounting assembly, and wherein the locking assembly is used for realizing locking while the power source upper cover closes the power source base.

2. The streetlight device according to claim 1, wherein the supporting plate fixing mechanism comprises a supporting plate slot disposed at the power source upper cover and a supporting plate locking structure, one end of the power source supporting plate is inserted into the supporting plate slot, and at least one of other ends of the power source supporting plate except the end inserted into the supporting plate slot is fixed onto the power source upper cover through the supporting plate locking structure.

3. The streetlight device according to claim 2, wherein the supporting plate locking structure comprises a threaded hole disposed at the power source upper cover and a handled screw for threaded connection with the threaded hole, at least one of the other ends of the power source supporting plate except the end inserted into the supporting plate slot is provided with a locking hole, and the handled screw partly passes through the locking hole to be connected to the threaded hole so as to lock the power source supporting plate.

4. The streetlight device according to claim 2, wherein the supporting plate slot is mounted onto the power source upper cover through a slot hinge.

5. The streetlight device according to claim 4, wherein the supporting plate locking structure comprises a supporting plate locking bracket, a supporting plate locking spring, a supporting plate locking tongue, and a locking tongue lever, the supporting plate locking bracket is fixed onto the power source upper cover, the supporting plate locking bracket is provided with a locking tongue hole and the locking tongue hole is open towards the power source supporting plate, the supporting plate locking tongue is disposed at the locking tongue hole through an extension-compression of the supporting plate locking spring, and the locking tongue lever is connected with the supporting plate locking tongue.

6. The streetlight device according to claim 1, wherein the power source base is provided with an internal compartment, and the internal compartment and the power source upper cover together form a compartment space for receiving the driving power source.

7. The streetlight device according to claim 6, wherein an upper edge of the internal compartment is provided with a sealing ring, and the sealing ring and the power source upper cover form a joint sealing.

8. The streetlight device according to claim 1, wherein the streetlight device is further provided with a driving adapter assembly, the driving adapter assembly comprises a first electrical connector disposed at the power source upper cover and a second electrical connector disposed at the power source base, the driving power source is connected to the first electrical connector, wherein the first electrical connector and the second electrical connector form a plug-in connection while the power source upper cover is rotated to close the power source base.

9. The streetlight device according to claim 8, wherein the driving power source and the first electrical connector are connected with each other through a quick coupling.

10. The streetlight device according to claim 1, wherein the locking assembly and the hinge assembly are disposed at different sides of the power source upper cover and the power source base, respectively.

11. The streetlight device according to claim 10, wherein the locking assembly comprises a clamping mount disposed at the power source upper cover, a clamping pin telescopically disposed at the clamping mount, and a clamping plate disposed at the power source base, a rear end of the clamping pin is connected with a clamping pin lever, a front end of the clamping pin is provided with a clamping pin limiting protrusion;

wherein the clamping mount is provided with a clamping pin resetting barrier, the rear end of the clamping pin passes through the clamping pin resetting barrier, the clamping pin is sleeved with a clamping pin resetting spring, the clamping pin resetting spring is elastically abutted between the clamping pin limiting protrusion and the clamping pin resetting barrier; and wherein the clamping plate is provided with a clamping hole, and the front end of the clamping pin is inserted into the clamping hole under an effect of the clamping pin resetting spring while the power source upper cover closes the power source base.

12. The streetlight device according to claim 11, wherein an end of the clamping plate away from the power source base is provided with a clamping guide part for jointing with the clamping pin so as to guide the clamping pin into the clamping hole.

13. The streetlight device according to claim 1, wherein the hinge assembly comprises a hinge mount, a hinge pivot and a hinge plate, the hinge pivot is telescopically disposed at the hinge mount and is connected with a pivot handle.

14. The streetlight device according to claim 13, wherein the hinge plate is provided with a pivot hole, the hinge mount is disposed at the power source base, and the hinge plate is disposed at the power source upper cover.

15. The streetlight device according to claim 14, wherein the hinge mount is disposed at the power source upper cover, the hinge plate is disposed at the power source base; wherein the hinge pivot is inserted into the pivot hole to realize rotating the power source upper cover so as to close or open the power source base.

16. The streetlight device according to claim 14, wherein a position that is close to the hinge mount and is protruded from a front end of the hinge pivot is provided with a locating slot, the hinge plate is inserted into the locating slot, and the hinge pivot is protruded into the locating slot and is inserted into the pivot hole.

17. The streetlight device according to claim 13, wherein the hinge mount is provided with a pivot limiting part for jointing with the pivot handle so as to limit a displacement of the hinge pivot.

18. The streetlight device according to claim 13, wherein the hinge assembly further comprises a pivot resetting mechanism for resetting the hinge pivot to a stretched-out state.

19. The streetlight device according to claim 13, wherein the lighting portion comprises an upper lighting shell, a lower lighting shell, and a lighting module, the upper lighting shell is integrally connected with the power source upper cover, the lower lighting shell is provided with a dustproof transparent mask, the upper lighting shell is connected with the lower lighting shell to form a lamp panel space, the lighting module is disposed within the lamp panel space, and the lighting module and the driving power source are connected with each other through a quick coupling.

* * * * *